US006181874B1

(12) United States Patent
Ireland et al.

(10) Patent No.: US 6,181,874 B1
(45) Date of Patent: Jan. 30, 2001

(54) HEATING ELEMENT

(75) Inventors: Peter Thomas Ireland; David Richard Hugh Gillespie; Zuolan Wang, all of Oxford (GB)

(73) Assignee: Isis Innovation Limited, Oxford (GB)

( * ) Notice: Under 35 U.S.C. 154(b), the term of this patent shall be extended for 0 days.

(21) Appl. No.: 09/029,223

(22) PCT Filed: Aug. 16, 1996

(86) PCT No.: PCT/GB96/02017

§ 371 Date: Nov. 6, 1998

§ 102(e) Date: Nov. 6, 1998

(87) PCT Pub. No.: WO97/08918

PCT Pub. Date: Mar. 6, 1997

(30) Foreign Application Priority Data

Aug. 30, 1995 (GB) ..... 9517643

(51) Int. Cl.[7] ..... H05B 3/40

(52) U.S. Cl. ..... 392/497; 392/398; 392/478

(58) Field of Search ..... 392/398, 424, 392/468, 471, 472, 473, 478, 485, 486, 487, 488, 489, 490, 497; 219/206, 211, 212, 529, 534, 535, 545, 548, 551, 552; 338/208; 123/546, 549, 593; 261/142

(56) References Cited

U.S. PATENT DOCUMENTS

| | | | | |
|---|---|---|---|---|
| 1,484,616 | | 2/1924 | Aske . | |
| 1,484,617 | | 2/1924 | Aske . | |
| 3,784,786 | * | 1/1974 | Calvert, Sr. | 392/485 |
| 3,811,271 | * | 5/1974 | Sprain | 219/206 |
| 3,927,300 | * | 12/1975 | Wada et al. | 392/485 |
| 4,025,754 | * | 5/1977 | Marzonie et al. | 392/485 |
| 4,108,125 | * | 8/1978 | Marcoux et al. | 219/206 |
| 4,245,146 | * | 1/1981 | Shioi et al. | 392/485 |
| 4,245,631 | * | 1/1981 | Wilkinson et al. | 392/473 |
| 4,264,888 | * | 4/1981 | Berg | 392/485 |
| 4,491,118 | | 1/1985 | Wooldridge | 123/549 |
| 4,581,522 | * | 4/1986 | Graham | 219/545 |
| 4,723,973 | * | 2/1988 | Oyobe et al. | 392/488 |
| 5,254,840 | * | 10/1993 | Thompson | 392/485 |
| 5,278,940 | * | 1/1994 | Muller | 392/485 |
| 5,475,203 | * | 12/1995 | McGaffigan | 219/545 |
| 5,597,503 | * | 1/1997 | Anderson et al. | 392/485 |

FOREIGN PATENT DOCUMENTS

| | | | |
|---|---|---|---|
| 3936933 | 5/1991 | (DE) | H05B/3/82 |
| 1001409 | 2/1952 | (FR) | 5/8 |
| 2220829 | 1/1990 | (GB) | H05B/3/20 |

* cited by examiner

*Primary Examiner*—Teresa Walberg
*Assistant Examiner*—Fadi H. Dahbour
(74) *Attorney, Agent, or Firm*—Volpe & Koenig, P.C.

(57) ABSTRACT

A heating element made of metal mesh through which electric current may be passed to heat fluid passing through the mesh. The mesh is made of intersecting metal wires defining apertures though which the fluid to be heated passes. These apertures are made small enough to cause all the heating to be achieved by conduction and convection. Typical apertures sizes are 40 to 60 $\mu$m effective diameter.

15 Claims, 4 Drawing Sheets

HEATING ELEMENT

This invention relates to a heating element for heating fluids and to a heater incorporating such an element.

It is known to provide an electric heater in which current is passed through a mesh of interconnected wires. Such a heater, used for fusion welding of plastics, is described in U.S. Pat. No. 5,475,203. In this heater, the mesh is sandwiched between layers of plastics material in order to provide heat to weld same together. In the present invention a mesh is used to heat a flowing stream of fluid—gas or liquid—passing through it.

The invention is thus directed primarily at an electrically powered heating element of the type which is placed in a moving fluid stream so that the fluid is heated as it passes the element. Heaters made from such elements are widely used in many fields, commercial, industrial and domestic. It is anticipated that the heating element of this invention will find similar broad application.

In accordance with a first aspect of the invention, there is provided a heating element comprising a mesh made of intersecting strands of filamentary material arranged to define a plurality of apertures through which a fluid to be heated may pass, at least some of said strands being electrically conductive whereby current may be supplied to said strands to heat same, the element being characterised in that said apertures are sufficiently small that all or substantially all of the fluid passing through each said aperture is heated by conduction and/or convection.

In accordance with a second aspect of the invention, there is provided a heating element comprising a mesh made of intersecting strands of filamentary material arranged to define a plurality of apertures through which a fluid to be heated may pass, at least some of said strands being electrically conductive whereby current may be supplied to said strands to heat same, the element being characterised in that said apertures each have an effective diameter of less than 500 $\mu$m.

In a heater incorporating the heating element of the invention, means are provided for passing an electric current across the mesh, thus supplying the energy necessary for heating the fluid. The mesh, which will normally be generally planar, is mounted so as to at least partially intersect the fluid stream to be heated. In a particular embodiment, for example, the fluid to be heated may be passed, for example by pumping, along a conduit, and the mesh placed across the conduit so that all of the fluid is constrained to pass through one of the fine apertures in the mesh. In accordance with the invention the apertures should be fine enough to ensure that all or substantially all of the fluid passing through each aperture is heated by conduction and/or convection.

The mesh is attached to electrodes to which an electrical supply is connected to supply current to the mesh. To this end the mesh must be constructed so as to define an electrical path between the electrodes. Preferably the mesh is such as to give a substantially constant heating effect over its whole area; however, there may be circumstances in which the heating pattern could with advantage be tailored to suit particular specialist applications by providing, for example, relative cool areas of the mesh.

In order to maintain dimensional stability, it is preferred that the mesh is of woven construction; however, other techniques such as friction welding could be used to fabricate a non-woven mesh.

Whether woven or not, it is preferred that a simple construction of mesh is used, comprising two sets of filamentary strands crossing at right angles in the manner of the warp and weft of a conventional fabric. The strands of at least one of the sets should be of conductive material, and attached between the electrodes so that electrical current can be passed through them; not all of such strands in said one set need be of conductive material. It may be possible for non-conductive strands to be incorporated with the conductive strands, consistent with maintaining a reasonably constant overall heating effect, as aforesaid, or ensuring that a particular tailored heating effect is achieved.

The filamentary strands of the other set—those that extend laterally across those carrying the current—may also be conductive, or they may be non-conductive.

In a particular embodiment of the invention the mesh comprises a commercially-available woven wire cloth in which conductive wire is used in both warp and weft. The wire can be made from any suitable conductive material such as stainless steel, resistance wire, Nichrome wire, copper or aluminium wire or carbon fibre. In some applications, the wire may be made from a low melting point alloy (such as solder) to render the chance of overheating or combustion impossible. A material with a high positive temperature coefficient of resistance, for example barium tantalate, would automatically limit the mesh temperature in the event of a drop in fluid flow due, for example, to a blockage. Mesh failure due to flow restriction may be prevented by the use of a pressure actuated switch which only permits current to be supplied to the mesh when the pressure difference across the mesh faces, caused by the flow through the mesh, exceeds a prescribed value. The material used will depend upon the particular circumstances of use; in particular the nature of the fluid being heated.

The heating element operates by means of $I^2R$ losses in the conductive strands of the mesh causing the strands to heat up and transfer heat energy to the passing fluid by conduction and convection. The heating element is effective because the fluid stream being heated is divided into many sub-streams each one of which passes through a respective aperture in the mesh. Heating thus occurs as the sub-stream passes through its respective aperture and, in the present invention, these apertures are made small—with typical dimension of the order of 40 to 60 $\mu$m in order to achieve maximum convective efficiency. Convective efficiency is defined by:

$$\eta_c = \frac{\text{actual heat transferred}}{\text{ideal heat transferred}}$$

Heat transferred is measured in watts. The ideal quantity is achieved when the fluid being heated leaves the heat exchanger at the same temperature as that of the heat exchanger.

This will now be discussed in relation to a fluid passing along a conduit whose walls are heated to thereby transfer heat energy to the fluid. In such a conduit, a thermal boundary layer can be defined immediately against the inside wall of the conduit in which the fluid receives heat purely by conduction from the conduit wall. The process of heat transfer from a wall to a fluid is, at the wall surface, via conduction. This is true within the wall and the fluid. The transfer of heat from the bounding surface throughout the thermal boundary layer is by combined conduction and transport (or movement) of fluid. This latter, combined, process is called convection. It is fairly apparent that, as the fluid progresses down the conduit, the thickness of this boundary layer will increase until eventually it comprises the whole cross section of the fluid. In the ideal heat exchanger (in which the fluid being heated leaves at the heater exchanger temperature), all of the fluid at the exit must be heated so that the thermal boundary layer must extend across the full conduit. To a first order, the rate at which boundary layers grow on a body immersed in a fluid, for a given fluid and a given flow velocity, is fixed. The heat transfer passages in the mesh heater of the present invention are effective because the passage dimension in the flow direction is comparable to the thickness of the boundary layers which grow on the heater elements (wires) and, by this means, the requirement that all, or substantially all, of the fluid passing through each aperture is heated by conduction and/or convection is satisfied. An alternative way of under-standing the high performance of the heater mesh is in terms of the established equation for convective efficiency. The convective efficiency of a heat exchanger, for engineering purposes, can be approximated well by the expression:

$$\eta_c = 1 - \exp\left(-4\frac{l}{d}St\right)$$

where I=length of conduit d=diameter of conduit

St is the Stanton number which is a dimensionless parameter given by:

$$St = \frac{h}{\rho uc}$$

where h=average heat transfer coefficient

ρ=density of fluid u=velocity of fluid c=specific heat capacity of fluid.

It is evident from the above formula that, for best convective efficiency, the ratio I/d should be larger, rather than smaller, and to give an acceptable convective efficiency, ratios in the range 10 to 20 would be regarded as typical for a normal heating arrangement of this type. Clearly, however, the ratio I/d for each aperture in a mesh of the type envisaged in the present invention will not even approach such a range and the convective efficiency of the mesh as a whole can normally be expected therefore to be poor. In practice, such poor convective efficiency would manifest itself as an overheated mesh with poor heat energy transfer to the fluid being heated.

Surprisingly, however, convective efficiencies much better than would be expected from a casual interpretation of the above formula have been realised. In the present invention this has been achieved by using an extremely fine mesh with apertures having effective diameters less than 500 μm but preferably less than 200 μm and typically between 10 and 100 μm. in a typical commercially-available woven mesh, the apertures are approximately square in cross-section—bounded by the four adjacent stainless steel wires of the warp and the weft—and have a mean size of approximately 60×60 μm. The wire diameter is approximately 40 μm. The most effective range for the ratio of the gap size (distance between wires) g and diameter of wires d is as follows:

$$0.1 < \frac{q}{d} < 10$$

Other commercially-available meshes have rectangular (non-square) apertures and these would exhibit improved convective efficiency provided the width of the rectangle (the short side) is in the range quoted above.

The reason for this improved convective efficiency at such small aperture dimensions is thought to lie in an exponent b which relates the Nusselt number to the Reynolds number:

Nusselt number=A (Reynolds number)$^b$ where A is a constant dependent upon geometry.

The Nusselt number is given by:

$$\frac{hd}{k}$$

where k is the thermal conductivity of air.

The Reynolds number is given by:

$$\frac{\rho ud}{\mu}$$

where μ—viscosity of fluid.

It is found that the value of b is always less than unity and, since the Stanton number is inversely proportional to the diameter d raised to the exponent (1-b), the Stanton number invariably increases as the diameter decreases. At sufficiently small values of d, the larger value of St can compensate for the low value of $$\frac{l}{d}$$

in the formula for convective efficiency quoted above.

It will be appreciated that, in the above discussion, the variable d is the diameter of a notional conduit of circular cross section. However, these same principles can be applied to conduits of non-circular cross section (such as the apertures in the mesh of the present invention) where the value d can be considered to be an effective diameter. Likewise the conduit is assumed to have a constant cross section in the direction of flow which is not of course the case when considering the apertures of the present invention.

Using a mesh having fine apertures, as described above, we have been able to construct a heater having an acceptable convective efficiency and which runs cool.

It is seen that the smaller the diameter/effective diameter d, the greater the convective efficiency; however very small values of d will unduly impede the flow of fluid, and will tend to clog easily. The clogging problem can be reduced by making the heating element readily removable so that it can be removed for cleaning periodically. The excess mesh temperature associated with local flow restriction has, under certain conditions, enabled the mesh to act in a self cleaning manner.

In order that the invention may be better understood, an embodiment thereof will now be described by way of example only and with reference to the accompanying drawings in which.

Figure 1:
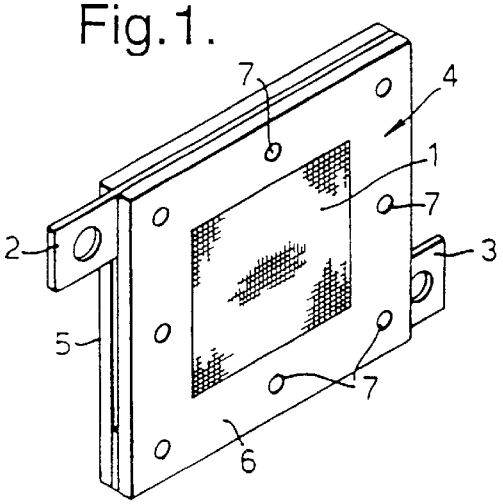
FIG. 1 is a perspective view of a small heater element constructed in accordance with the invention.
Figure 2:
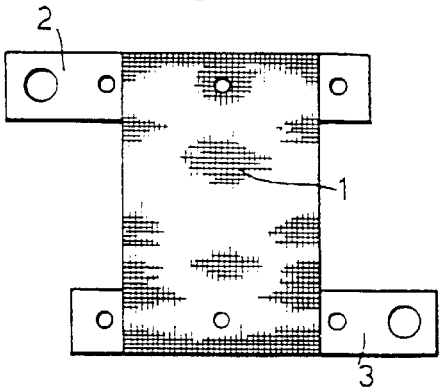
FIG. 2 is a view of the mesh assembly used in the heater element of FIG. 1.
Figure 3A:
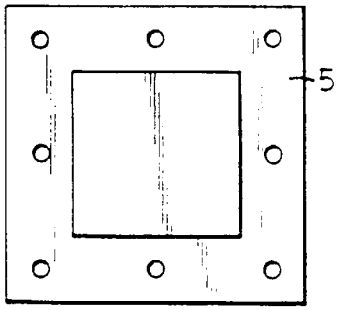
Figure 4A:
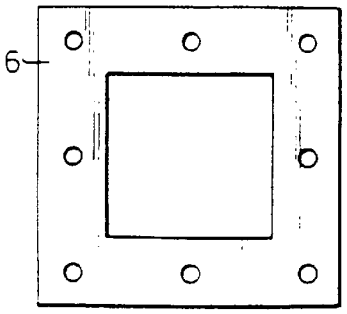
Figure 5:
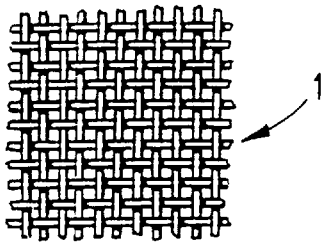
Figure 6:
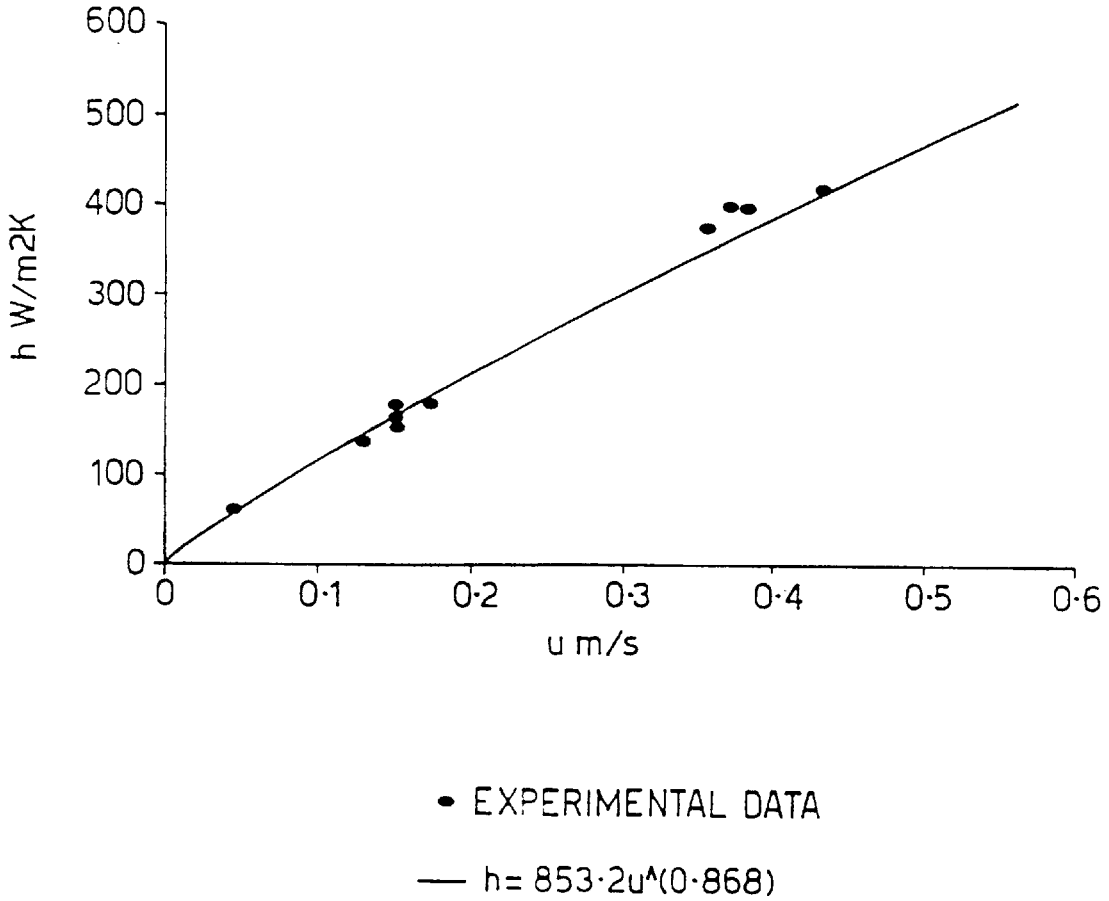
Figure 7:
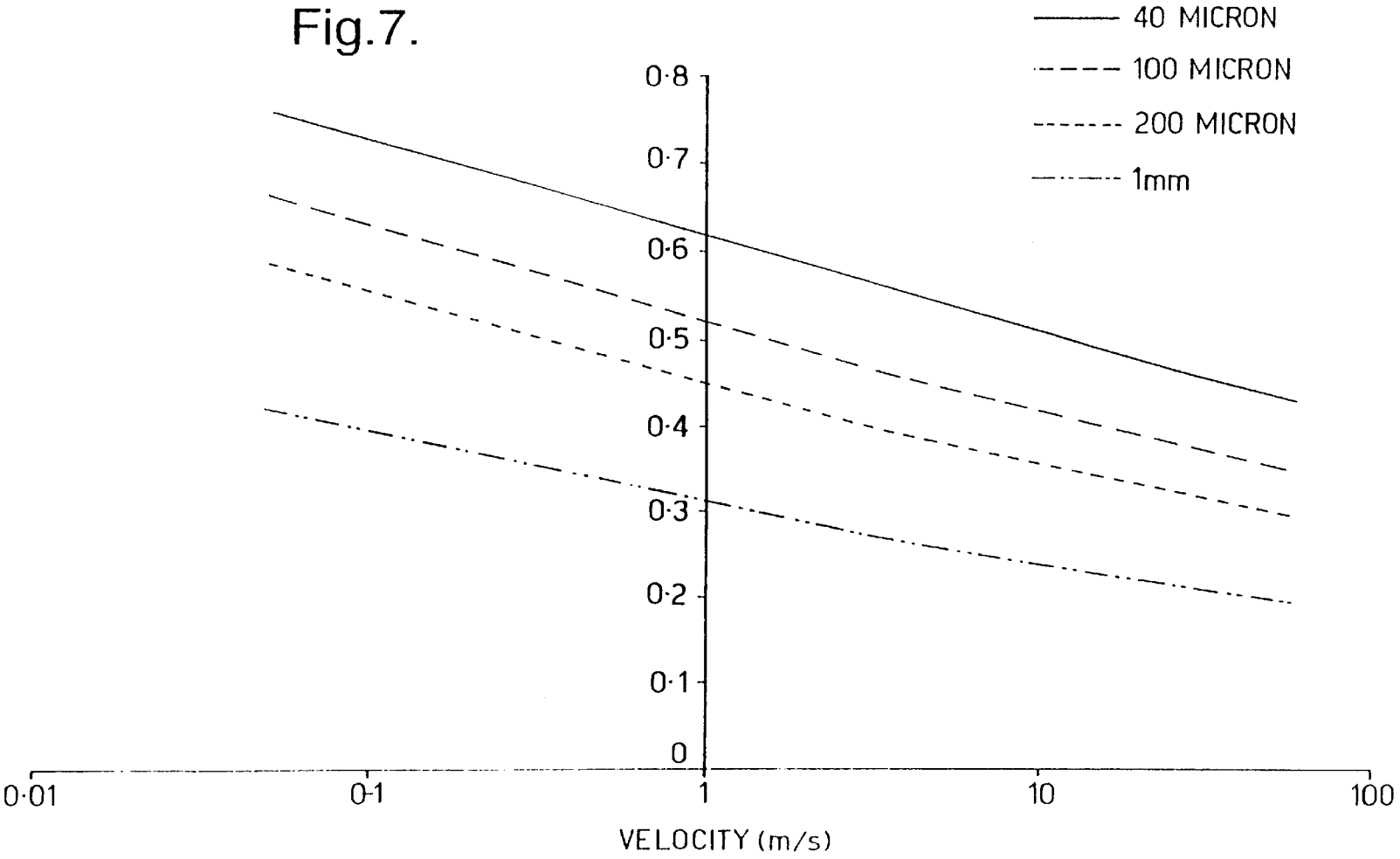
Figure 8:
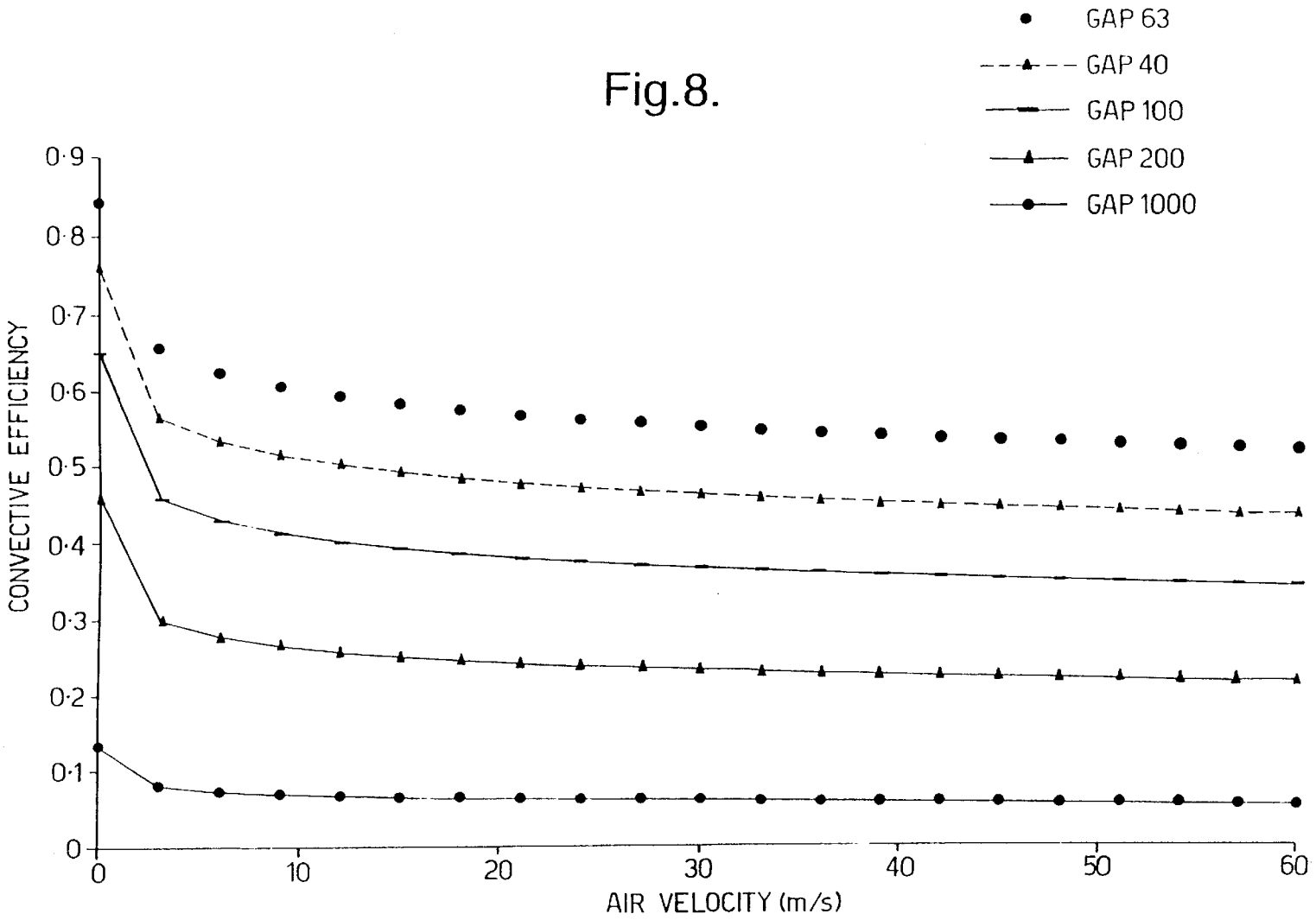

FIGS. 3A and B are plan and edge views respectively of one section of the frame used to mount the mesh assembly in the heater element of FIG. 1;

FIGS. 4A and B are views similar to FIGS. 3A and B respectively, showing the other frame section;

FIG. 5 is an enlarged view of the mesh to illustrate the weave used;

FIG. 6 is a graph of heat transfer coefficient against fluid velocity;

FIG. 7 is a graph plotted from theory of convective efficiency against fluid velocity, showing the effect of varying the wire diameter; and FIG. 8 is a graph similar to that of FIG. 7, but showing the effect of varying the gap size.

A typical small heater element is illustrated in FIGS. 1 to 4. The element comprises a wire mesh 1 attached along two opposite sides by soldering to brass terminal bars 2, 3 respectively. The brass terminal bars are connected to a source of electrical power (not shown) to drive electric current, AC or DC, through the mesh 1.

The mesh used in the illustrated embodiment is a commercially-available mesh made by G Bopp and Co AG. As can be seen in the enlarged view of FIG. 5, the mesh comprises warp and weft wires 10, 11 respectively in a plain weave, although other weaves are available and could be used in the present invention. The wires are stainless steel having a diameter of 40 $\mu$m and with a wire spacing in both warp and weft directions of approximately 60 $\mu$m.

Figure 3B:
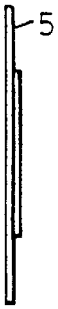
Figure 4B:
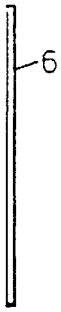

The mesh assembly is located in a frame 4 made up of two sections 5, 6 illustrated in FIGS. 3 and 4 respectively. The mesh assembly is sandwiched between the frame sections 5 and 6 and is located there by rivets 7 or similar attachment devices. The section of the frame in contact with the mesh is constructed from an electrical insulator and is preferably resistant to ignition should the mesh fuse in the event of the flow being restricted and any overheat pressure switch which is fitted (see above) malfunctioning. This could be a high temperature plastic such as Polyether Ether Ketone (PEEK) or Tufnol.

For the purpose of analysis (see below) the frame is dimensioned; however, it will be clear that other sizes and other shapes are possible. In a heater, what is necessary is that the heater element is mounted so that the fluid to be heated is caused to pass through the mesh 1, and the heater element will therefore be made of a size and shape to suit the circumstances.

The arrangement shown is intended for heating a flowing stream of gas, in particular air, which is blown through the mesh by means of a pump (not shown); however, the same principle can be applied to the heating of a flowing liquid although, like for like, it is probable that lower convective efficiencies will result, in which case it may be necessary to place a number of heating elements into the liquid stream so that the liquid flows through them in series.

The electrical power required to heat the air by a particular amount can be readily calculated:

Mass flow rate=u×ρ×area of mesh

Assuming $\mu$–30 m/sec and ρ=1

Mass flow rate=$30\times1\times(0.05)^2$=0.075 kg/sec

Power required=mass flow rate×c×($T_{out}$–$T_{in}$)

where $T_{out}$=output temperature (°C.)

$T_{in}$=input temperature (°C.)

c=specific heat of the fluid at constant pressure

Assuming $T_{in}$=20° C. and $T_{out}$=60° C., then:

Power required=0.075×1004×(60–20)=3012 Watts

Electrical Power=FR

The resistance of the specified mesh is 0.06U per square. Therefore:

$$i^2 = \frac{3012}{0.06}$$

Therefore i=224A.

The power supply must thus be capable of passing a current in excess of 200 A through the mesh. Even at this magnitude of current the convective efficiency of the mesh is such that it runs quite cool. The convective efficiency is related to the inlet and outlet temperatures as follows:

$$\eta_c = \frac{T_{out} - T_{in}}{T_m - T_{in}}$$

where $T_m$=mesh temperature.

Thus for a convective efficiency of 60%, the mesh temperature is 87° C.

The rate q at which heat energy is transferred into the flowing fluid stream is given by:

q=area of mesh×h($T_m$–$T_{in}$)W/m$^2$ where h is the heat transfer coefficient in W/m$^2$/°K.

The heat transfer coefficient is the key factor in this equation and is dependent upon the physical properties of the particular arrangement. We have plotted values of h for different air velocities u and compared them with the theoretical value, and the results are shown in FIG. 6. We have also plotted some values of convective efficiency against velocity u for various values of wire diameter and these are shown in FIG. 7. The graphs of FIG. 7 are plotted from theory, but we have obtained comparable results in practice. In FIG. 7, the ratio of gap size (distance between wires) to wire diameter stayed fixed at 64/40. FIG. 8 is similar to FIG. 7, but shows the estimated effect of changing the size of the gap, measured in microns, where the wire diameter is kept constant at 63 microns. As can be clearly seen, the convective efficiency falls with increasing gap size.

We have used a number of the above-described heating elements in a variety of situations and using different overall sizes, but the same mesh size in each case. The elements have been found to be extremely effective as general-purpose air heaters for flowing air in a velocity range from 0.05 m/s to 60 m/s. They are particularly useful in research where it is necessary, for experimental purposes, to provide a very rapid or "step" change in air temperature. It has been found that the mesh heater of the present invention can realise an almost perfect step change of temperature in a flowing fluid stream, an effect which is not otherwise obtainable, except with expensive, bulky and complicated heating arrangements. For example, experiments to measure the heat transfer coefficient h can be readily carried out by this technique. However, it is thought that the heater could have more general application than this from industry to domestic use for heating both gases and liquids. For example, a prototype water heater, using the teachings of the invention, has been built and its performance agrees with that predicted from theory; thus a very compact instant response water heater could be fabricated. Another particular use could be in the implementation of fast response electrical heaters for vehicle screen demisting, particularly under cold start conditions; in such an application air supplied by the existing vehicle blowers is directed through the mesh to heat the air until such time as the engine cooling water has warmed up. Such a heater would have the advantages of low pressure drop, and the potential to site the heater close to the duct outlets. A safety device, for example incorporating a pressure switch as described above, could be fitted to shut off the current supply to the heater in the event of a blockage.

Various modifications can be made to the arrangement illustrated. For example, in order to allow operation from higher supply voltages, the mesh may be divided into sections, in a horizontal direction in FIG. 2, each section being electrically isolated form the next, except that the various sections are interconnected in series to give higher resistance across the whole, to which a higher voltage supply is connected. A more resistive mesh may alternatively, or in addition, be used.

In the commercial mesh shown in FIG. 5, both the warp and weft wires are made from conductive wire—stainless steel, in fact. In an alternative construction the weft wires can be made from an insulating material such as nylon or polypropylene yarn or glass or ceramic fibre. In such a construction, the mesh is orientated such that the warp wires provide the connection between the terminal bars 2 and 3. Insulating wires/yarns can also be incorporated in the warp wires and the heating pattern tailored to suit individual requirements, as mentioned above.

What is claimed is:

1. A heating element comprising a mesh made of intersecting strands of filamentary material arranged to define a plurality of apertures through which a fluid to be heated may pass, at least some of said strands being electrically conductive and coupled to electrical terminals whereby current may be supplied to said strands via said terminals to heat same, the element being characterized in that said apertures have a width of less than 500 $\mu$m between the conductive strands whereby substantially all of the fluid passing through each said aperture is heated by conduction and/or convection.

2. A heating element as claimed in claim 1 in which said width is less than 200 $\mu$m.

3. A heating element as claimed in claim 1 in which the range of the quantity ratio of aperture width w and diameter of strands d is as follows:

$$0.1 < \frac{w}{d} < 10.$$

4. A heating element as claimed in claim 1 wherein said mesh comprises two sets of filamentary strands crossing substantially at right angles in the manner of the warp and weft of a fabric.

5. A heating element as claimed in claim 4 wherein one set of filamentary strands is wholly or partly composed of electrically conductive strands, and the other set of filamentary strands are wholly of non-conductive material.

6. A heating element as claimed in claim 4 wherein both sets of filamentary strands are wholly or partly composed of electrically conductive strands.

7. A heating element as claimed in claim 1 wherein the mesh comprises a woven wire cloth.

8. A heating element as claimed in claim 1 wherein the material from which the filamentary strands are made is one with a high positive temperature coefficient of resistance.

9. A heater comprising a heating element as claimed in claim 1, further including means for pumping a fluid to be heated through the apertures in said mesh and a source of electrical supply connected to supply electric current to said electrically conductive strands.

10. A heating element as claimed in claim 1 where said width between conductive strands is in the range of 10 to 100 $\mu$m.

11. A heating element comprising a mesh made of intersecting strands of filamentary material arranged to define a plurality of apertures through which a fluid to be heated may pass, at least some of said strands being electrically conductive whereby current may be supplied to said strands to heat same, the element being characterised in that said apertures each have an effective diameter of less than 500 $\mu$m.

12. A heating element as claimed in claim 11 in which each aperture has an effective diameter of less than 200 $\mu$m.

13. A heating element as claimed in claim 11 wherein said effective diameter is in the range of 10 to 100 $\mu$m.

14. A heating element comprising a mesh made of intersecting strands of filamentary material arranged to define a plurality of apertures through which a fluid to be heated may pass, at least some of said strands being electrically conductive whereby current may be supplied to said strands to heat same, the element being characterized in that the distance between conductive strands is less than 200 $\mu$m whereby a thermal boundary layer which is defined during heat transfer on the surface of the filamentary strands completely or substantially completely fills each aperture.

15. A heating element as claimed in claim 14 where said distance between conductive strands is in the range of 10 to 100 $\mu$m.

* * * * *